US005609002A

United States Patent [19]

Fernandez

[11] Patent Number: 5,609,002

[45] Date of Patent: Mar. 11, 1997

[54] SECURITY WINDOW BAR SYSTEM

[76] Inventor: Bruce Fernandez, 23 Walden Rd., Rochester, N.Y. 14610

[21] Appl. No.: 570,900

[22] Filed: Dec. 12, 1995

[51] Int. Cl.[6] ..... E06B 3/68

[52] U.S. Cl. ..... 52/507; 52/667; 49/50

[58] Field of Search ..... 52/507, 667, 720.3, 52/202; 49/61, 62, 57, 464, 50; 411/911

[56] References Cited

U.S. PATENT DOCUMENTS

| | | | |
|---|---|---|---|
| 481,915 | 8/1892 | Norrman | 52/667 |
| 3,161,450 | 12/1964 | Goodenough | 411/911 X |
| 4,162,590 | 7/1979 | Earley | 49/57 X |
| 4,400,912 | 8/1983 | Wicks, Sr. | 49/57 |
| 4,669,239 | 6/1987 | Maggs et al. | 52/720.3 X |
| 5,150,885 | 9/1992 | Leone | 52/667 X |

*Primary Examiner*—Carl D. Friedman

*Assistant Examiner*—Timothy B. Kang

*Attorney, Agent, or Firm*—Shlesinger Fitzsimmons Shlesinger

[57] ABSTRACT

The subject of this invention is a security window bar system containing three types of elements. The first type comprises a plurality of vertical bars, the second type comprises at least two horizontal metal plates, and the third a plurality of right angular, generally L-shaped brackets or fasteners. The vertical bars are held in place by the horizontal crossbars which have therethrough spaced openings which the vertical bars extend. Opposite ends of the horizontal crossbars are fastened to opposite sides of the window frame by the L-shaped fasteners, each of which has one leg fastened to an adjacent end of a crossbar, and the opposite leg fastened to the window framework by a one-way screw. The result is a simple, inexpensive, and easy to install window bar grid system that prevents unwanted intruders from entering the structure.

7 Claims, 1 Drawing Sheet

SECURITY WINDOW BAR SYSTEM

BACKGROUND OF THE INVENTION

This invention relates to a home or business security device. In particular, this invention relates to the prevention of unwanted intruders from gaining ingress into a building through a window, typically a basement window, by covering the window opening with a simple system of metal bars.

In recent years home security has become an increasingly serious issue. With the incidents of burglary on the rise, there is an increased need for homes and businesses to employ preventative devices to eliminate forced entry through building windows.

One major problem is that most known such devices for preventing forced entry are often complicated, expensive, difficult to install, and difficult to operate. The average homeowner or business owner has little or no knowledge about such devices, and limited or no equipment with which to install such a device.

For example, U.S. Pat. Nos. 4,653,226, 5,392,570, 5,334,971, and 4,817,334 (Badger) each describes a security device in the form of a window bar system. These window bar systems contain features such as removability from the inside, a lock and key mechanism, and, as with Badger, the ability to fit to a range of window sizes. However, in spite of their features, these window bar systems contains many drawbacks. They are expensive to manufacture, contain numerous parts, and are difficult for the average homeowner to install. Although U.S. Pat. No. 4,416,084 (Zen) describes a window bar system without these drawbacks, Zen's window bar system secures the vertical bars at the sashes while the present invention secures the vertical bars in the window opening where they intersect the horizontal crossbars.

It is an object of this invention, therefore, to provide for a window opening a security device or kit of the type described which is inexpensive and contains few parts.

Another object of this invention is that such device be simple to install and require no special tools, so that the instructions for installing this device may be very brief and simple, thus enabling the average homeowner to install the device.

Other objects of this invention will be apparent hereinafter from the specification and from the recitation of the appended claims, particularly when read in conjunction with the accompanying drawings.

SUMMARY OF THE INVENTION

The device comprises a plurality of vertical metal bars held in a window opening by a couple of horizontal crossbars. The crossbars are in turn secured to the window framework itself.

There are two aspects to the invention. The first pertains to the way in which the horizontal crossbars are attached to the window framework. Each horizontal crossbar is an elongate, flat strip of metal with its longitudinal side edges folded into overlapping spaced relation with one side of the bar, thus forming on the bar two, elongated flanges that overlie said one side of the bar. This allows one leg of each of two smaller strips of metal, which are bent into L-shaped brackets or fasteners, to be slid onto each end of a crossbar beneath its flanges. The opposite end of each of the brackets contains a hole where a one-way screw is used to fasten the bracket, and hence the adjacent end of the horizontal bar, to the building itself.

The second aspect of the invention is that the vertical metal bars are not physically attached to either the crossbars or the structure itself. Instead, they fit through openings in the crossbars. The horizontal crossbars contain equally spaced openings which are just large enough to accommodate the vertical metal bars. When the device is assembled, the vertical bars are kept in place by the two crossbars and by the upper and lower faces of the window opening and are held in a vertical position by the two horizontal crossbars.

A separate embodiment is used in the case where the upper edge of the window framework is arched, or where there is no beam cover extending over the top of the window. In this situation, if the first embodiment were employed, it would be possible to remove the vertical bars from the structure with little effort. This separate embodiment employs a metal strip to cover the upper ends of the vertical bars. Unlike the first embodiment, the metal strip would not have openings in which the vertical bars would pass through. Instead, the metal strip would contain sockets in which the vertical bars would rest. Thus, using the second embodiment, it would be impossible to remove the vertical bars after installation, even though there is no beam extending over the top of the window.

THE DRAWINGS

DETAILED DESCRIPTION OF THE PREFERRED EMBODIMENTS

Figure 1:
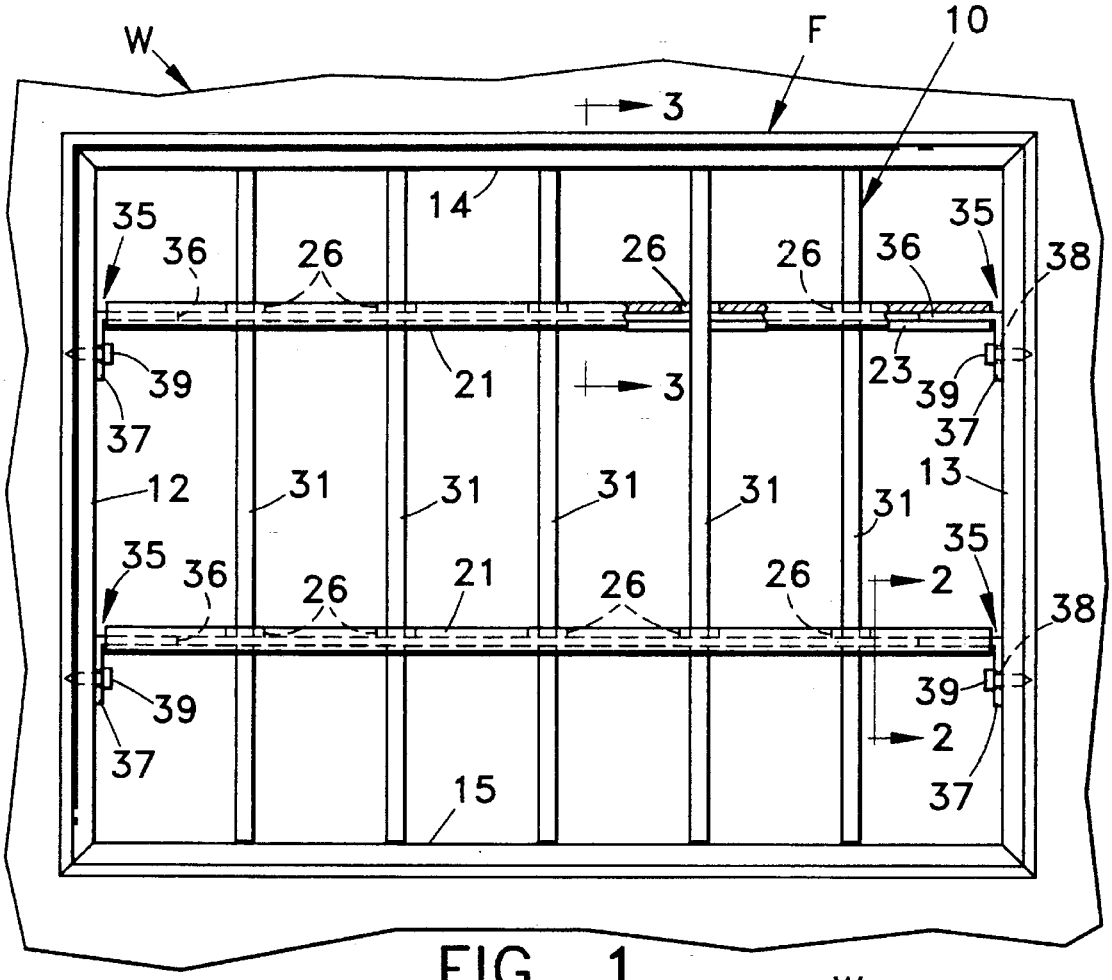
FIG. 1 is a front elevational view of a security window bar system made according to one embodiment of this invention as it appears when installed in the frame of a window forming part of a housing wall that is shown fragmentarily, and with portions of one of the system's crossbars being broken away and shown in section.
Figure 2:
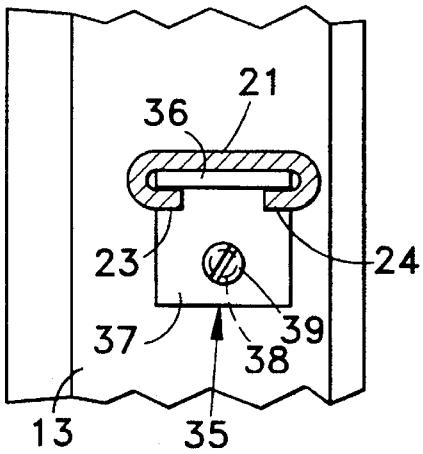
FIG. 2 is an enlarged fragmentary sectional view taken generally along the line 2—2 in FIG. 1 looking in the direction of the arrows.
Figure 3:
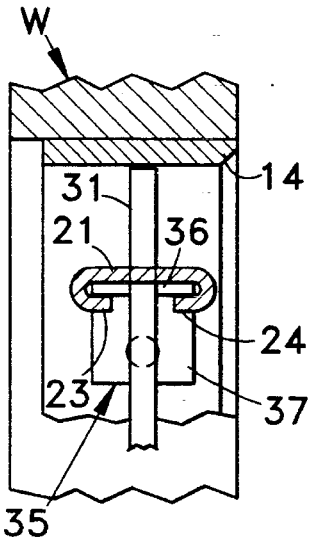
FIG. 3 is an enlarged sectional view on a slightly smaller scale taken generally along line 3—3 in FIG. 1 looking in the direction of the arrows.

Referring now to the drawings by numerals of reference, and first to FIG. 1, 10 denotes generally a security window bar system which is secured, as noted hereinafter, in the frame F of a window which forms part of a wall W of a house or building. The frame F which is secured in an opening in the wall W, is rectangular in configuration, and has a pair of spaced, parallel side walls 12 and 13, a header or top wall 14, and a sill or bottom wall 15.

In the embodiment illustrated, system 10 comprises two metal crossbars 21, which are identical in configuration, and which are disposed to be mounted in spaced, parallel horizontal relation across the opening of the window frame F as shown in FIG. 1. As noted in greater detail hereinafter, the horizontal crossbars 21 support vertically in the opening in the frame F, and in spaced, parallel relation to each other, a plurality (five in the embodiment illustrated) of like steel bars 31, which in cross section are rectangular in configuration. Each crossbar 21 comprises a flat, metal strip marginal portions of which along its longitudinal side edges are folded or rolled into overlapping, spaced relation to one side of the associated bar, thus forming on each of the crossbars 21 two, elongate flanges 23 and 24, the longitudinal edges of which are disposed in spaced, confronting relation to each other. Intermediate its ends the portion of each bar 21 which registers with the space between its flanges 23 and 24 has therethrough a plurality (five in the embodiment illustrated) of equispaced, rectangular openings 26, each of which is adapted to accommodate slidably therein a portion of one of the vertical bars 31, when the system is assembled as shown in FIG. 1. For this reason the cross sectional area of each opening 26 is slightly larger than the cross sectional area of the respective bar 31 which is disposed to pass therethrough.

To secure the system 10 in the opening in the window frame F, each of the crossbars 21 is adapted to be secured at opposite ends thereof to the opposed sides 12 and 13 of the frame F by means of a pair of right angular brackets 35. Each bracket 35 comprises a first leg section 36, which is slidably inserted into one end of a respective crossbar 21 to have marginal portions thereof adjacent its longitudinal side edges slidably supported on the flanges 23 and 24 of the associated crossbar 21. The other leg section 37 of each bracket 35 is seated flush against one of the sidewalls 12 or 13 of the associated frame F, and has therein a central opening 38 for accommodating the shank of a one-way screw 39, which is used to secure a respective bracket 35 to the adjacent sidewall 12 or 13 of the window frame.

Generally, for certain types of houses, there are three standard window sizes, each being approximately thirty-two inches in width and either twelve inches, fourteen inches or eighteen inches in height. Typically, therefore, system 10 of the type described will utilize a plurality of crossbars 21, which are slightly less in length than thirty-two inches, and vertical bars 31, which are slightly less than twelve inches, fourteen inches or eighteen inches in length. Assuming, for example, that the system 10 shown in FIG. 1 is to be secured in a window opening thirty-two inches by eighteen inches, the system or kit, which would be provided for blocking the window opening, would comprise five bars 31 each of which would be slightly less than eighteen inches in length, and two crossbars, each of which would be slightly less than thirty-two inches in length. The openings 26 in the crossbars register with the space between the confronting edges of the flanges 23 and 24, so that they will not impede the movement of a vertical bar 31 through a respective opening 26.

To assemble the system into the window frame F, the legs 36 of a pair of brackets 35 are inserted into opposite ends of each crossbar 21, the vertical bars 31 are then inserted into the openings 26 in the crossbars, and the assembly is positioned in the opening in the frame F in the manner shown in FIG. 1. Thereafter, the one-way screws 39 are employed to secure legs 37 of the four brackets 35 to the frame sidewalls 12 and 13, as shown in FIG. 1. Since the legs 36 of the brackets 35 project slidably into opposite ends of the crossbars 21, it is possible to use the same crossbar for window openings of different widths, depending upon the length of the leg 36 of each bracket 35. Thus, slight variations in the width of the window will not interfere with the installation of the system. Also, although only one opening 38 has been illustrated in each leg 37 of a bracket 35, obviously the leg 37 can be made longer and may be provided with a plurality of such openings 38, if desired, in order to accommodate a plurality of one-way screws 39. Moreover as shown in the drawings the openings 26 are slightly larger than the bars 31 which extend therethrough, thereby permitting the bars to shift slightly laterally and forwardly or rearwardly in the openings 26 in the supporting crossbars 21, but without permitting rotation of bars 31 in openings 26. This makes it extremely difficult for one to attempt to saw through the metal bars 31. Once the system 10 has been installed in the frame F the upper and lower sides 14 and 15, respectively, of frame F prevent removal of the vertical rods 31. Also the one-way screws 39 prevent removal of the screws, thereby providing a essentially burgular-proof security device for the window.

Figure 4:
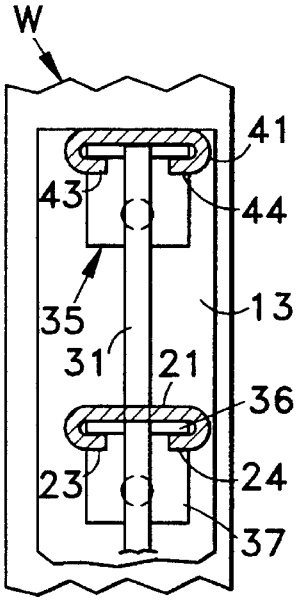
FIG. 4 is a sectional view similar to FIG. 3 but showing a modified system including a special crossbar which functions as a cap for the system when employed in a window frame which is open or arched at its upper end.

In some instances the window frame F may not have an upper retaining or closing wall 14, such as for example when the window opening has a curved upper end, or simply is open because of the manner in which the associated wall W was constructed. In such a case an additional crossbar of the type denoted at 41 in FIG. 4 is employed to cover the upper ends of the bars 31. Bar 41, although similar in configuration to the crossbars 21, does not have therethrough a plurality of openings 26 for accommodating the bars 31. On the contrary, the portion of the bar 41 between its flanges 43 and 44, which are comparable to the flanges 23 and 24 on crossbar 21, is completely solid so that bar 41, when secured at opposite ends thereof to the frame sidewalls 12 and 13 by a pair of brackets 35, completely overlies the upper ends of the associated vertical bars 31, and therefore prevents removal of the bars from the system, after the latter has been mounted in the window opening.

From the foregoing it will be apparent that the present invention provides a relatively simple and inexpensive means for preventing intruders from gaining access to a building or house through a window opening. The security system disclosed herein comprises only a few parts which are not complicated, and are rather inexpensive to manufacture. A further advantage is the fact that the system is simple to install in a window opening. For example there are only three major steps in installing the device—namely, (1) installing the vertical bars 31 into the openings in the horizontal crossbars 21, (2) inserting the legs 36 of a pair of brackets 35 into opposite ends of a respective crossbar, and (3) securing the other legs 37 of the brackets by the one-way screws 39 to opposite sides 12 and 13 of the window frame. In addition there are only four different parts that are required to complete the system—namely, the vertical bars 31, the horizontal crossbars 21, the right angular brackets 35 and the one-way screws 39. Thus this system may be produced in the form of kits which are ready to be inserted into a window opening with a minimum of tools, for example a screw driver and a drill. Because the device is quick and easy to install, it requires few tools, and it permits an ordinary homeowner who has no knowledge of carpentry, to install the security system in household windows.

While bars 31 have been described as the vertical bars, and bars 21 as the horizontal or crossbars, it will be apparent that, if desired, the bars 31 could be mounted horizontally across the window opening, in which case bars 21 would extend vertically and would be fastened by brackets 35 to the header 14 and sill 15, respectively. Also, although the brackets are shown to have flat legs 37 and 36, the exact shape of the legs could be modified without departing from this invention, provided one leg can be fastened to the window frame so that the other leg will prevent removal of the adjacent end of a bar 21 from the frame.

Although the invention has been illustrated and described in detail in connection with only certain embodiments thereof, it will be apparent to one skilled in the art that it is capable of still further modification, and that this application is intended to cover any such modifications as it may fall within the scope of one skilled in the art or the appended claims.

I claim:

1. A security window bar system for preventing unauthorized entry through the opening in a window frame of the type having a sill and a pair of spaced side walls projecting upwardly from the sill, comprising a first plurality of elongate bars each having therethrough intermediate opposite ends thereof a plurality of longtitudinally spaced openings, and having in each of said opposite ends thereof a longitudinally extending recess, a second plurality of bars each having a cross sectional area smaller than the area of each of said openings in said first plurality of bars, whereby each of said second plurality of bars is slidable intermediate opposite ends thereof in any of said openings in said first plurality of bars, and means for mounting at least one pair of said first plurality of bars at said opposite ends thereof in said frame to extend in spaced relation to each other transversely between the side walls of said frame with the spaced openings in one of said pair of bars registering with the spaced openings in the other of said pair of bars and with at least one of said second plurality of bars extending slidably through each pair of registering openings in said one pair of bars and resting movably at the lower end thereof on said sill, said mounting means comprising at least two pairs of generally right-angular brackets each having a pair of integral legs extending substantially at right angles to each other, each of said brackets disposed to have one leg thereof seated slidably in said recess in one end of one of said pair of bars of said first plurality thereof, and with the other leg thereof confronting upon one of said side walls of said frame, and means for permanently securing each of said other legs of said brackets to said side wall of the frame upon which said other leg confronts.

2. A security window bar system as defined in claim 1, wherein said means for permanently securing said other legs of said brackets to said frame comprises a plurality of one-way screws which thread through openings in said other bracket legs into said frame side walls.

3. A security window bar system as defined in claim 1, wherein each of said first plurality of bars comprises an elongate metal strip having marginal portions of the longitudinal side edges thereof, at least adjacent opposite ends thereof, folded into overlapping, spaced relation to one side of said strip thereby forming said longitudinally extending recess in each end thereof.

4. A security window bar system as defined in claim 1, including one additional bar similar to the bars of said first plurality of bars except that said additional bar extends without interruption from one end to the other thereof, and does not have any spaced openings therethrough intermediate its ends.

5. A security window bar system as defined in claim 1, wherein the length of each of the bars of said first plurality thereof is slightly less than the distance separating said side walls of said frame.

6. A security window bar system as defined in claim 1, wherein each of said second plurality of bars is rectangular in cross section, each of said openings in said bars of said first plurality thereof is rectangular in configuration, and said openings in said bars of said first plurality thereof permit slight lateral movement of the bars of said second plurality thereof relative to the bars of said first plurality.

7. A security window bar system as defined in claim 2, wherein said one leg of each of said brackets has opposed, plane surfaces, and said other leg of each of said brackets has therethrough an opening for accommodating the shank of one of said one-way screws.

* * * * *